US006485278B2

(12) United States Patent
Reuter et al.

(10) Patent No.: US 6,485,278 B2
(45) Date of Patent: Nov. 26, 2002

(54) PUMP WITH IMPROVED COLD TEMPERATURE PERFORMANCE

(75) Inventors: David Fredrick Reuter, Beavercreek, OH (US); Earl Wayne Lloyd, Lebanon, OH (US)

(73) Assignee: Delphi Technologies, Inc., Troy, MI (US)

( * ) Notice: Subject to any disclaimer, the term of this patent is extended or adjusted under 35 U.S.C. 154(b) by 42 days.

(21) Appl. No.: 09/775,182

(22) Filed: Feb. 1, 2001

(65) Prior Publication Data

US 2002/0102170 A1 Aug. 1, 2002

(51) Int. Cl.[7] ..... F04B 53/12
(52) U.S. Cl. ..... 417/549
(58) Field of Search ..... 417/470, 549

(56) References Cited

U.S. PATENT DOCUMENTS 640,911 A * 1/1900 Hiett ..... 417/549
921,155 A * 5/1909 Perez ..... 417/549
1,023,685 A * 4/1912 Ruwell ..... 417/549

* cited by examiner

*Primary Examiner*—Michael Koczo
(74) *Attorney, Agent, or Firm*—Scott A. McBain

(57) ABSTRACT

Cold temperature performance of a pump for a controlled braking systems is enhanced, and internal flow restrictions of the pump are minimized, by placing the poppet return spring in a separate cavity out of the flow path through the pump. The separate spring cavity also allows travel of the poppet to be limited, thereby also limiting the loss of volumetric efficiency due to flow forces generated by cold, viscous fluid pushing the poppet an increasing distance from the seating area.

10 Claims, 2 Drawing Sheets

PUMP WITH IMPROVED COLD TEMPERATURE PERFORMANCE

TECHNICAL FIELD

This invention relates to a pump with improved cold temperature performance for use in controlled vehicle braking systems, such as adaptive braking systems, traction control systems, and vehicle stability enhancement systems.

BACKGROUND OF THE INVENTION

Controlled braking systems, such as adaptive braking systems, traction control systems, and vehicle stability enhancement systems, use a pump to force brake fluid to the vehicle brakes during such controlled operation. The pump must be self priming and must be able to force brake fluid, even cold viscous brake fluid, to one or more of the vehicle brakes in a relatively short time period. For example, a driver performing a quick steering maneuver which causes the vehicle to oversteer will require a counter-braking moment on the opposite front wheel to occur almost instantaneously in order to correct the skid condition. Accordingly, the pump must quickly extract brake fluid from the reservoir and force it to the appropriate brake under increasing pressure loads. The problem of quick response is particularly acute during cold weather operation, where the viscosity of the brake fluid places severe limitations on pump performance. Accordingly, to enhance cold weather performance, it is desirable to minimize internal restrictions within the pump, provide a pump having a relatively high compression ratio, and limit the travel of the pump inlet poppet.

SUMMARY OF THE INVENTION

According to the present invention, internal flow restrictions of the pump are minimized because the poppet return spring is placed in a separate cavity completely out of the flow path through the pump. The spring is a simple compression spring instead of the complex barrel spring used in prior art designs. Any viscous drag created by the spring and separate spring cavity is minimized by incorporating a slotted head on the poppet stem, in addition to grooves on the stem that permit fluid displacement between the spring cavity and the flow path through the pump. The spring cavity is closed by a wear button which extends from the piston and is engaged by an eccentric bearing to drive the pump piston, thereby enabling the rest of the assembly to be made of a softer steel. Poppet travel is limited by a step on the poppet stem or separate poppet retainer which contacts a corresponding face on the housing. Accordingly, the problem of the poppet continuing to open more and more at cold temperatures in response to increased brake fluid viscosity and resulting flow forces on the poppet is eliminated.

DESCRIPTION OF THE PREFERRED EMBODIMENT

Figure 1:
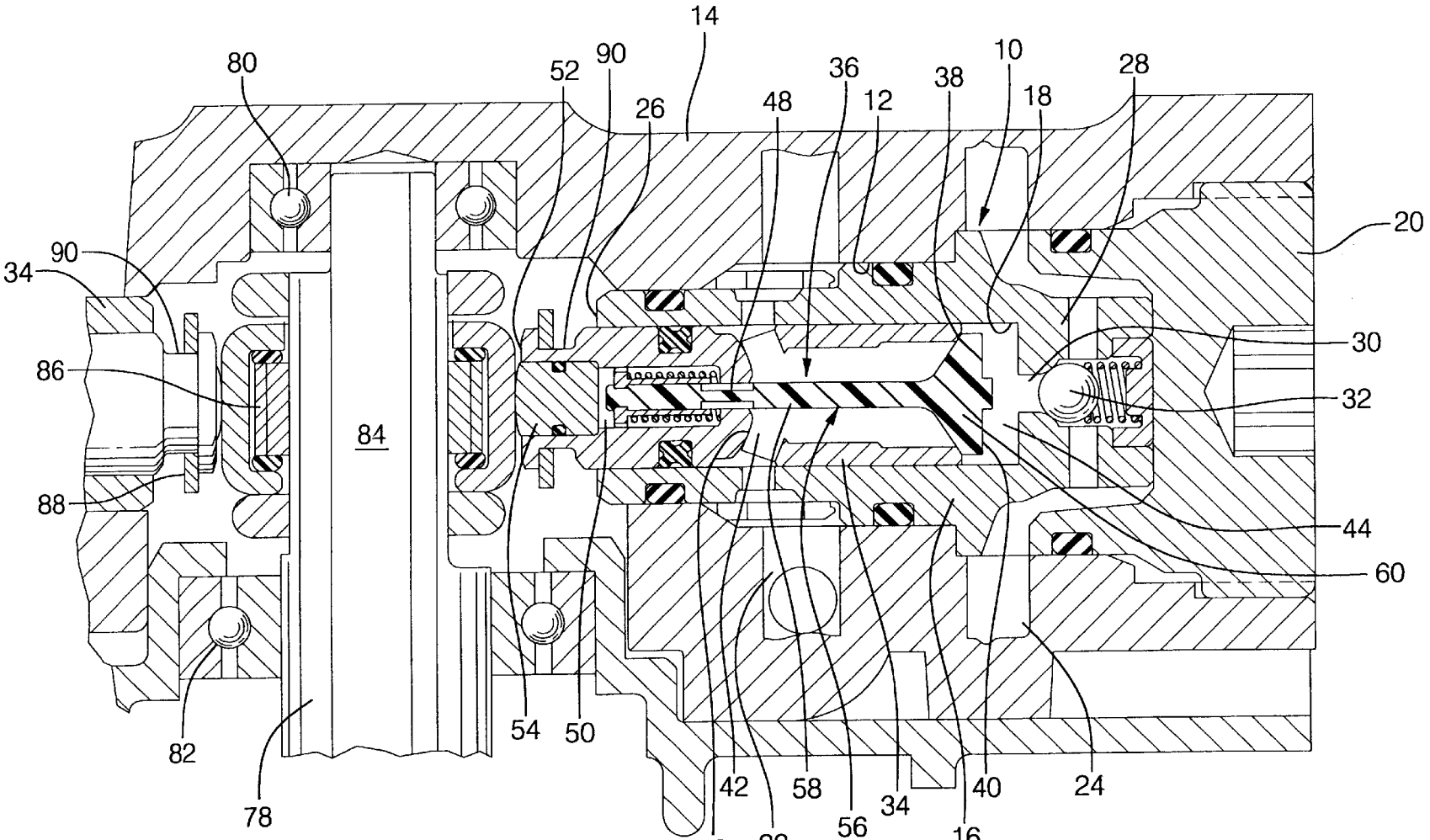
FIG. 1 is a fragmentary cross sectional view taken through a pump assembly make according to the teachings of the present invention.

Referring now to the drawings, a pump assembly generally indicated by the numeral 10 made according to the present invention is mounted in a bore 12 of a typical housing 14 of a brake pressure modulator. The pump 10 includes a housing sleeve 16 defining a bore 18 therewithin. The housing sleeve 16 is mounted in bore 12, which is closed by a plug 20. The housing 14 includes an inlet passage 22, which is communicated with a fluid reservoir, and an outlet passage 24, through which the pumped fluid is communicated. The bore 18 extends through open end 26 of the housing sleeve 16, and the opposite end 28 of the sleeve 16 is provided with an outlet opening 30, which communicates bore 18 with the outlet passage 24. A spring loaded, one way check valve 32 permits fluid to flow from bore 18 to the outlet passage 24, but prevents flow in the reverse direction.

A pump piston 34 is slidably mounted in the bore 18 and is movable toward and away from the end 28 of the sleeve 12 to effect pumping of fluid. Pump piston 34 defines a chamber 36, which terminates in an open end 38 circumscribed by a valve seating area 40. Accordingly, the chamber 36, the bore 18 and the outlet opening 30 define a flow path communicating the inlet passage 22 with the outlet passage 24. The valve seating area 40 divides the flow path into an inlet section 42 communicated with inlet passage 22 and a pumping section 44 communicated with outlet opening 30. The end of the chamber 36 opposite the valve seating area 40 terminates in a wall 46 through which an aperture 48 extends. The aperture 48 communicates the inlet section 42 with a spring cavity 50 defined within pump piston 34. The end 52 of pump piston 34 opposite end 38 terminates in an opening. End 52 is closed by a wear button 54, which defines the end of spring cavity 50. The wear button 54 is made of a wear resistant material as compared to the material from which the remaining components of the pump 10 are made.

Communication through the aforementioned flow path is controlled by a poppet generally indicated by the numeral 56, which cooperates with the valve seating area 40. The poppet 56 includes a stem 58 which extends through the inlet section 42 and the aperture 48, and into the spring cavity 50. The poppet 56 further includes a circumferentially extending, radially outwardly projecting head 60 which projects from the stem 58 and engages and moves away from the valve seating area 40 during operation of the pump 10. It will be noted that the volume of the stem 58 extending through the chamber 36 is relatively small, thereby maximizing the volume of the chamber 36 through which fluid may communicate during normal operation of the pump 10.

The end 62 (FIG. 2) of the poppet 56 opposite the end which carries the head 60 terminates within the spring cavity 50. End 62 is provided with a circumferentially extending groove which receives radially inwardly extending portion 64 of a sleeve 66 which is split longitudinally (not shown) so that it may be snapped over the end 62 of the stem 58 with the inwardly extending portion 64 received in the groove on the stem 58. Alternately, the sleeve 66 may be slipped over the end 69 of poppet 56 with the radially outward projection 73 being formed after assembly by a suitable peening, staking, or heat staking process. The sleeve 66 carries a radially outwardly projecting, circumferentially extending shoulder 68 that faces a corresponding radially extending surface 70 on the piston 34 defining the end of the spring cavity 50. A spring 72 acts between the shoulder 68 and the surface 70, thereby urging the poppet 56 to the left viewing the Figures, so that the poppet head 60 will be urged into engagement with the valve seating area 40. However, the travel of the poppet 56 away from the valve seating area will be limited to that attained when front face 71 of sleeve 66 engages surface 70. This method of restricting poppet travel is low cost and minimizes tolerance stack-ups so that tight manufacturing tolerances may be maintained for the travel limit. It will also be noted that the spring 72 is a simple compression spring, and not the more complex springs required in prior art designs. Longitudinally extending, circumferentially spaced grooves 74 are provided on the outer circumferential surface of the portion of the stem 58 that extends through the aperture 48 to facilitate flow of fluid from the inlet section 42 of the chamber 36 into the spring cavity 50. Circumferentially spaced slots 76 are provided around the radially outwardly extending portion of the sleeve 66 to minimize viscous drag on the poppet 56.

Reciprocation of the pump piston 34 is effected by rotation of a shaft 78 which is rotatably mounted in the housing 14 by bearings 80,82. The shaft 78 may be rotated by any appropriate device, such as an electric motor (not shown). Shaft 78 includes an eccentric portion 84, the motion of which is transferred to wear button 54 by an eccentric bearing 86 to thereby reciprocate the piston 34. A suitable circumferential retaining clip 88 is preloaded into piston grooves 90 to keep the faces of the wear buttons 54 tight against the bearing 86 riding on shaft eccentric 84 during the pump suction stroke.

Figure 2:
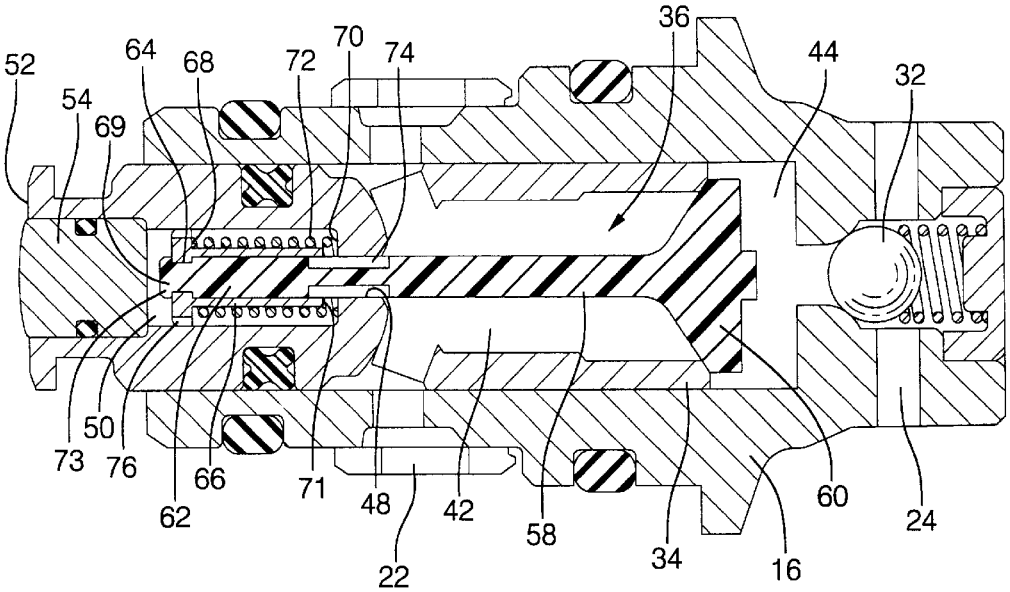
FIG. 2 is an enlargement of a portion of FIG. 1, to better illustrate some of the components of the pump.
Figure 3:
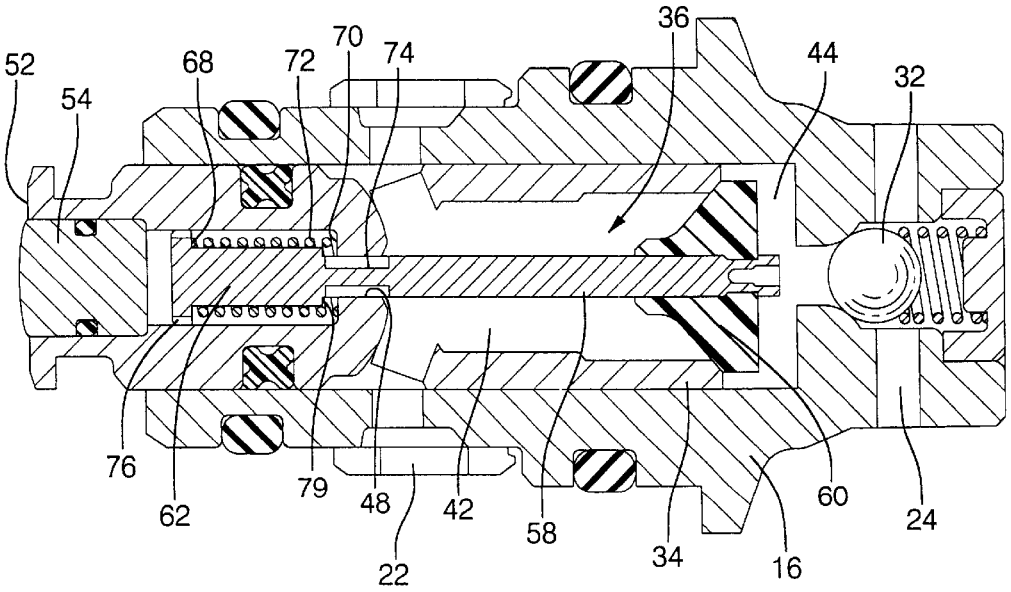
FIG. 3 is a view similar to FIG. 2, but illustrating another embodiment of the invention.

In the embodiment of FIGS. 1 and 2, the stem 58 and head 60 are integral and may be made from, for example, molded plastic. The poppet 56 is assembled with the piston 34 by inserting the stem 58 through the aperture 48 installing the spring 72 on the stem 58, and then snapping the sleeve 66 on the stem or alternately forming the extended radial end 73 of the poppet stem 58 by a suitable peening or staking operation as the final assembly step. In the embodiment of FIG. 3, the head 60 and stem 58 are separate pieces and the separate sleeve 66 is not necessary, since the stem 58 may be formed with a counterbored head 88 and the head 60 may be installed on the stem 58 after the stem has been installed in the aperture 48 and then subsequently swaged to form an enlargement of counterbore 88 as shown. Alternately, the stem 58 and poppet head 60 may be attached by a simple press fit.

In operation, when fluid must be pumped by the pump 10, the aforementioned electric motor (not shown) is started to turn the shaft 84 to thereby reciprocate the piston 34. As the piston 34 moves in its compression stroke (that is, the piston 34 moves to the right viewing the Figures, into the pumping section 44), fluid is forced past the check valve 32 and into the outlet passage 24. When the piston 34 passes through the top dead center position, the volume of the pumping section 44 is minimized and thereafter begins to increase. Accordingly, because of the reduced pressure in pumping section 44 and the relatively low force of return spring 72, the piston 34 withdraws from the head 60 of the poppet 56, permitting fluid to flow past the valve seating area 40 and into the pumping section 44. Thereafter, the piston 34 passes through the bottom dead center position and begins a compression stroke, thereby forcing the head 60 back into engagement with the valve seating area 40 due to the action of the spring 72 and the increase in pressure in the pumping section 44.

It will be noted that the compression spring 72 is displaced from the flow path through the chamber 36, and the volume of the stem 58 is relatively small. Accordingly, the flow path is relatively unobstructed, thereby minimizing the internal flow restrictions of the pump, thereby decreasing response time and increasing the efficiency of the pump, particularly under cold temperature conditions. In addition, the fluid volume close to the pumping chamber is maximized, further improving cold temperature pumping due to the vacuum induced volumetric expansion effects occurring within the fluid. Internal restrictions within the pump when cold, viscous fluid must be pumped are critical performance factors. Furthermore, the distance that the poppet head 60 is allowed to move away from the valve seating area 40 is limited since when face of retainer 66 hits the radial wall 70 or the equivalent step 79 in alternate design stem 58 hits the radial wall 70, the head 60 cannot move further away from seating area 40. In prior art designs, the colder and more viscous the fluid the greater the resulting flow forces, which tend to push the poppet head further away from the valve seating area 40. Accordingly, volumetric efficiencies were lost as more of the stroke of the piston 34 will be required merely to cause the poppet head 60 to close against the valve seating area 40 after the piston moves past bottom dead center. Accordingly, this loss of volumetric efficiency is limited.

What is claimed is:

1. Pump for pumping fluid comprising a housing sleeve defining a bore therewithin, said housing sleeve having an inlet and an outlet, a pump piston slidably mounted within said bore, said piston defining a chamber therewithin, said chamber defining a portion of a flow path between the inlet and the outlet, a poppet carried by the piston and movable between a closed position engaging a valve seating area defined on the piston and an open position displaced from said valve seating area for controlling flow of fluid through the flow path, said valve seating area dividing said flow path into an inlet section communicated to said inlet and a pumping section communicated to said outlet whereby movement of the piston into said pumping section pumps fluid through said outlet, and a spring urging said poppet into the closed position, said spring being displaced from said flow path to thereby minimize restrictions to flow of fluid through said flow path;

wherein said poppet includes a stem extending through said flow path and into a spring cavity, one end of said stem extending into said spring cavity and a head on the other end of said stem for engagement with said valve seating area, said spring being mounted in said spring cavity and engaging said stem to thereby bias said poppet to said closed position;

wherein said spring cavity is defined within said piston, and an aperture communicating said spring cavity with said chamber;

wherein said stem extends through said aperture and is slidably supported by said aperture;

wherein longitudinally extending grooves are provided on the portion of said stem extending through said aperture to facilitate flow of fluid between said chamber and said spring cavity.

2. Pump as claimed in claim 1, wherein a front face of a spring retainer near said one end of said stem engaging a radially extending surface on the piston within said spring cavity limits movement of said head away from the valve seating area.

3. Pump as claimed in claim 2, wherein said one end of said stem terminates in a radially outwardly projecting shoulder, said spring extending between said shoulder and a corresponding surface on said spring cavity.

4. Pump as claimed in claim 1, wherein an outlet check valve in said pumping section controls flow of fluid through said outlet, said check valve closing said outlet to permit movement of the piston out of the pumping section to draw fluid through said flow path into said pumping section.

5. Pump for pumping fluid comprising a housing sleeve defining a bore therewithin, said housing sleeve having an inlet and an outlet, a pump piston slidably mounted within said bore, said piston defining a chamber therewithin, said chamber defining a portion of a flow path between the inlet and the outlet, a poppet carried by the piston and movable between a closed position engaging a valve seating area defined on the piston and an open position displaced from said valve seating area for controlling flow of fluid through the flow path, said valve seating area dividing said flow path into an inlet section communicated to said inlet and a pumping section communicated to said outlet whereby movement of the piston into said pumping section pumps fluid through said outlet, and a spring urging said poppet into the closed position, said spring being displaced from said flow path to thereby minimize restrictions to flow of fluid through said flow path;

wherein said poppet includes a stem extending through said flow path and into a spring cavity, one end of said stem extending into said spring cavity and a head on the other end of said stem for engagement with said valve seating area, said spring being mounted in said spring cavity and engaging said stem to thereby bias said poppet to said closed position;

wherein said spring cavity is defined within said piston, and an aperture communicating said spring cavity with said chamber;

wherein said stem extends through said aperture and is slidably supported by said aperture; and wherein said one end of said stem terminates in a radially outwardly projecting shoulder engaging said spring, said shoulder defining slots to facilitate flow of fluid in said spring cavity.

6. Pump for pumping fluid comprising a housing sleeve defining a bore therewithin, said housing sleeve having an inlet and an outlet, a pump piston slidably mounted within said bore, said piston defining a chamber therewithin, said chamber defining a portion of a flow path between the inlet and the outlet, a poppet carried by the piston and movable between a closed position engaging a valve seating area defined on the piston and an open position displaced from said valve seating area for controlling flow of fluid through the flow path, said valve seating area dividing said flow path into an inlet section communicated to said inlet and a pumping section communicated to said outlet whereby movement of the piston into said pumping section pumps fluid through said outlet, and a spring urging said poppet into the closed position, said spring being displaced from said flow path to thereby minimize restrictions to flow of fluid through said flow path;

wherein said poppet includes a stem extending through said flow path and into a spring cavity, one end of said stem extending into said spring cavity and a head on the other end of said stem for engagement with said valve seating area, said spring being mounted in said spring cavity and engaging said stem to thereby bias said poppet to said closed position;

wherein said spring cavity is defined within said piston, and an aperture communicating said spring cavity with said chamber;

wherein said stem extends through said aperture and is slidably supported by said aperture; and wherein said spring chamber is defined by a wear button closing one end of the spring chamber and extending from a corresponding end of the piston for engagement with an eccentric drive member for reciprocating the piston within the housing.

7. Pump for pumping fluid comprising a housing sleeve defining a bore therewithin, said housing sleeve having an inlet and an outlet, a pump piston slidably mounted within said bore, said piston defining a chamber therewithin, said chamber defining a portion of a flow path between the inlet and the outlet, a poppet carried by the piston and movable between a closed position engaging a valve seating area defined on the piston and an open position displaced from said valve seating area for controlling flow of fluid through the flow path, said valve seating area dividing said flow path into an inlet section communicated to said inlet and a pumping section communicated to said outlet whereby movement of the piston into said pumping section pumps fluid through said outlet, a spring urging said poppet into the closed position, a spring cavity defined within said piston slidably receiving said poppet, said spring being mounted in said spring cavity, said spring cavity being communicated with said inlet section whereby fluid communicated through the flow path is also communicated into the spring cavity, wherein said poppet includes a stem extending through an aperture and slidably supported thereby, said spring engaging said stem to urge the poppet to the closed position;

wherein said stem extends through said inlet section and said valve seating area and into said pumping section, said poppet including an outwardly projecting head in said pumping section, said head moving toward and away from the valve seating area in response to said spring in said spring cavity and pressure differentials across said poppet; and wherein one end of said stem terminates in a radially outwardly projecting shoulder engaging said spring, said shoulder defining slots to facilitate flow of fluid in said spring cavity.

8. Pump as claimed in claim 7, wherein an outlet check valve in said pumping section controls flow of fluid through said outlet, said check valve closing said outlet to permit movement of the piston out of the pumping section to draw fluid through said flow path into said pumping section.

9. Pump as claimed in claim 7, wherein a face on a spring retainer contacting a corresponding surface on said housing prevents additional movement of the head away from the valve seating area.

10. Pump for pumping fluid comprising a housing sleeve defining a bore therewithin, said housing sleeve having an inlet and an outlet, a pump piston slidably mounted within said bore, said piston defining a chamber therewithin, said chamber defining a portion of a flow path between the inlet and the outlet, a poppet carried by the piston and movable between a closed position engaging a valve seating area defined on the piston and an open position displaced from said valve seating area for controlling flow of fluid through the flow path, said valve seating area dividing said flow path into an inlet section communicated to said inlet and a pumping section communicated to said outlet whereby movement of the piston into said pumping section pumps fluid through said outlet, a spring urging said poppet into the closed position, a spring cavity defined within said piston slidably receiving said poppet, said spring being mounted in said spring cavity, said spring cavity being communicated with said inlet section whereby fluid communicated through the flow path is also communicated into the spring cavity, wherein said poppet includes a stem extending through an aperture and slidably supported thereby, said spring engaging said stem to urge the poppet to the closed position;

wherein said stem extends through said inlet section and said valve seating area and into said pumping section, said poppet including an outwardly projecting head in said pumping section, said head moving toward and away from the valve seating area in response to said spring in said spring cavity and pressure differentials across said poppet; and wherein longitudinally extending grooves are provided on the portion of said stem extending through said aperture to facilitate flow of fluid between said chamber and said spring cavity.

* * * * *